US005971480A

United States Patent [19]

Maschke

[11] Patent Number: 5,971,480

[45] Date of Patent: Oct. 26, 1999

[54] SPINNING AND/OR SWINGING, HANGING SEAT FOR EROTIC PURPOSES

[76] Inventor: Michael Maschke, Taimerhofstrasse 24, 81927 Munich, Germany

[21] Appl. No.: 08/985,317

[22] Filed: Dec. 4, 1997

[30] Foreign Application Priority Data

Feb. 28, 1997 [DE] Germany ..... 297 04 329 U

[51] Int. Cl.[6] ..... A47D 13/10

[52] U.S. Cl. ..... 297/273; 5/122

[58] Field of Search ..... 297/273, 274, 297/281, 452.13, 452.22, 277; 5/929, 122; 472/118, 122; 600/38; 128/845

[56] References Cited

U.S. PATENT DOCUMENTS 375,096 12/1887 Ransweiler .
427,900 5/1890 Pearson .
688,368 12/1901 Waddel .
896,179 8/1908 Vance et al. .
1,104,609 7/1914 Blain .
1,390,502 9/1921 Clouser .
1,740,949 12/1929 Luery .
2,467,890 4/1949 Harvey .
4,101,165 7/1978 Hammer .
4,188,063 2/1980 Dusart .
4,375,110 3/1983 Murphy .
4,825,855 5/1989 Kundson, Jr. .
5,511,258 4/1996 Barr, Sr. .
5,673,444 10/1997 Middendorf .

*Primary Examiner*—Milton Nelson, Jr.
*Attorney, Agent, or Firm*—Fitzpatrick, Cella, Harper & Scinto

[57] ABSTRACT

There is a disclosed a rotatable seat which comprises a substantially rectangular seat element made of a flexible material and having a centrally disposed hole. The seat element is suspended from two parallel poles which in turn are suspended from the ends of a third pole. The third pole itself is suspended by means of ropes from a fixed point.

9 Claims, 9 Drawing Sheets

SPINNING AND/OR SWINGING, HANGING SEAT FOR EROTIC PURPOSES

BACKGROUND OF THE INVENTION

The invention concerns a spinning and/or swinging, hanging seat for erotic purposes, as it is shown in detail in the figures.

SUMMARY OF THE INVENTION

According to the present invention, there is provided a rotatable seat which comprises a frame and a substantially rectangular seat element. The frame is constructed to be fixed to one and singular point by means of a rope. The seat element is suspended from the frame and is made from a flexible material like fabric, netting or similar material and provided with a symmetrically and centrally disposed square or round hole. The frame comprises two spaced parallel poles from which the seat element is hung by means of loops at its corners. The frame also comprises a third pole which extends perpendicular to, and in a plane parallel to a plane through the two parallel poles, and crossing the parallel poles in the middle thereof. Each of the parallel poles is hung from a respective end of the third pole. Two ropes are provided with one end of each rope secured to a respective end of the third pole. The other ends of the two ropes are connected together above the middle of the third pole to form a connection which may be fixed to a fixed point.

DETAILED DESCRIPTION OF THE PREFERRED EMBODIMENTS

Figure 1:
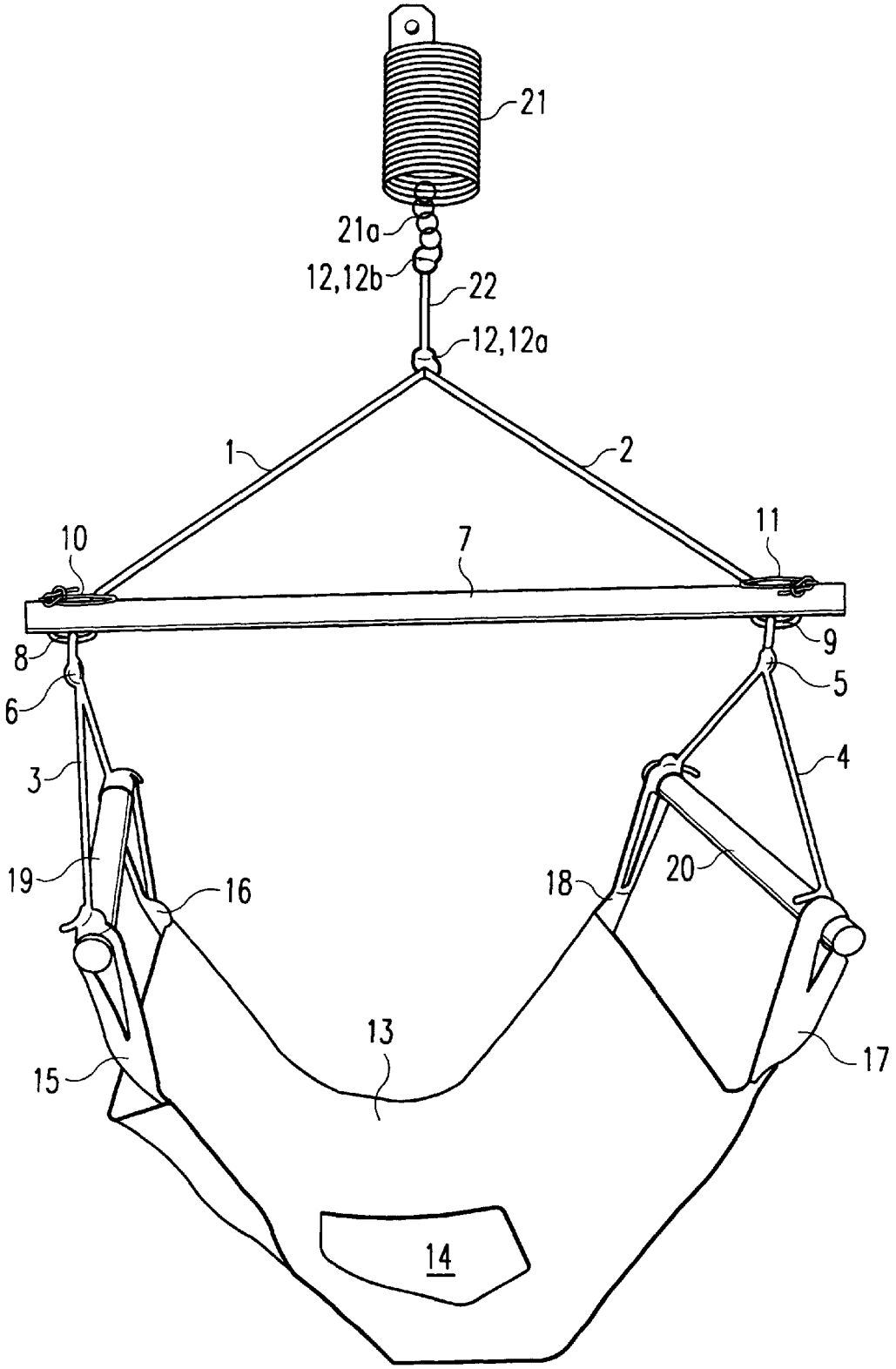
FIG. 1 is a perspective view of a frame and seat construction comprising a first embodiment of the invention.
Figure 1A:
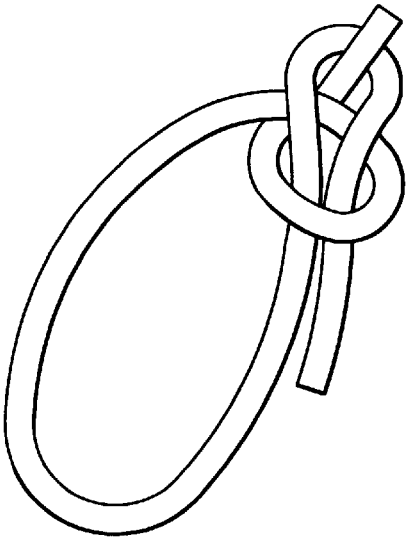
FIG. 1*a* is an illustration of a bowline knot for securing a rope to one end of a parallel pole forming part of the frame of FIG. 1.
Figure 1B:
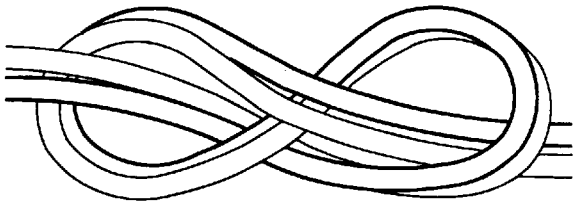
FIG. 1*b* is an illustration of a double figure eight knot used to secure the ends of a perpendicular pole, which also forms part of the frame of FIG. 1, to a single point suspension.

FIG. 1 shows a hanging, spinning, swinging, bobbing, shaking seat for erotic purposes which can be folded up, therefore a spinning, swinging bobbing, shaking love-seat which hangs from the room ceiling. It will be fastened with a plug. The standard position is: The man is lying on his back, the woman floats cross-legged above him. When you rotate the woman, the rope winds up. When let go, the woman winds down by herself.

Figure 3:
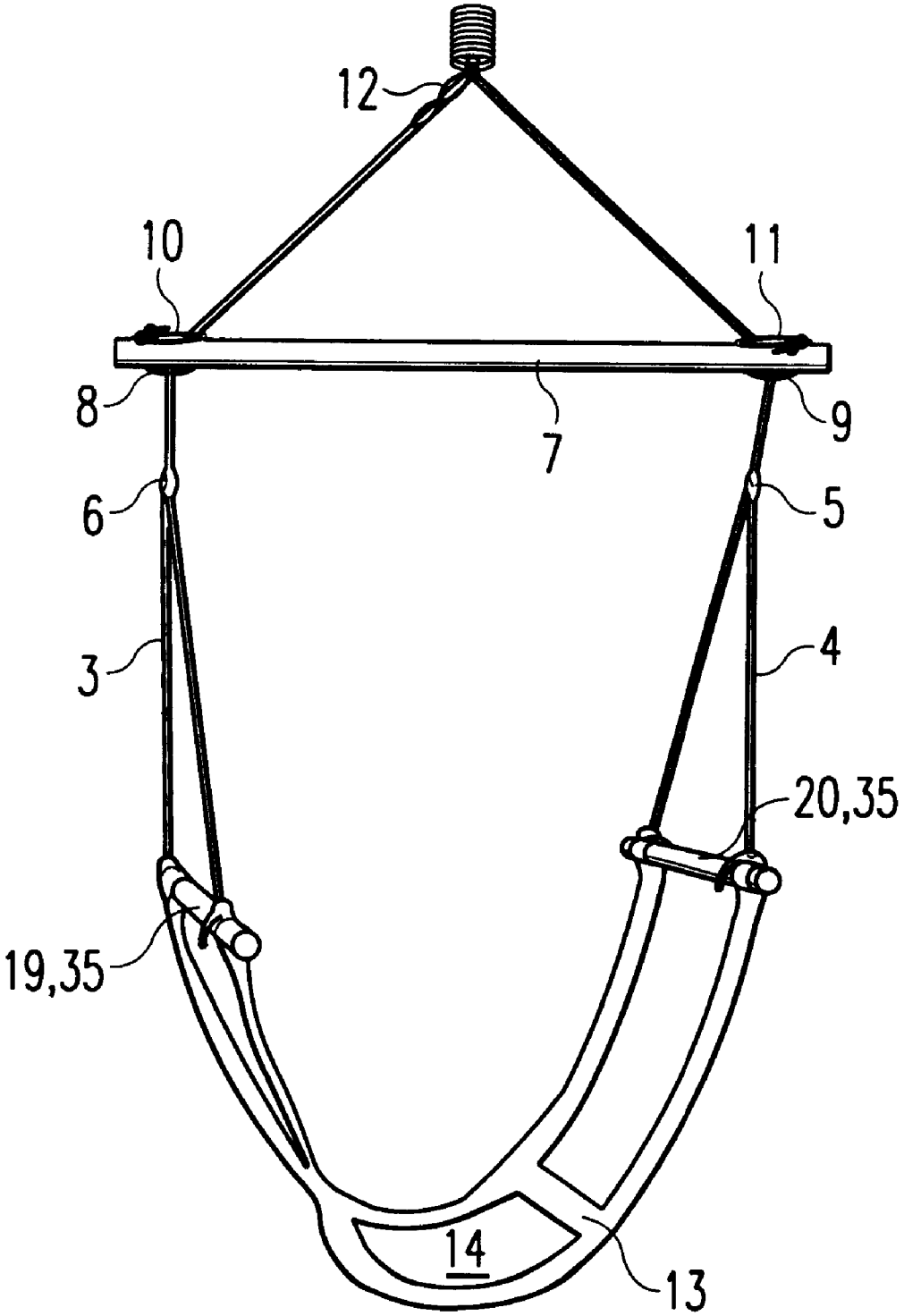
FIG. 3 is a view similar to FIG. 1 but showing an alternate form of seat construction.

FIG. 3 shows a hanging, swinging bobbing, shaking seat for erotic purposes which can be folded up, therefore a swinging bobbing, shaking love-seat which hangs from the room ceiling. It will be fastened with a plug. The standard position is: The man is lying on his back and the woman floats above him.

An accompanying stand (23) (FIG, 10) is available for both seats! It consists of 65 cm (longest part) long aluminium parts which, when put together, stands at a height of 2.38 m (corresponding to the height of the ceiling). The width is 1.90 m and fits over any double-bed. When taken apart it takes up only half of a tennis bag and weighs only 25 kg. It can be put together anywhere. The stand has the capacity to hold even over 100 kg.

Figure 10:
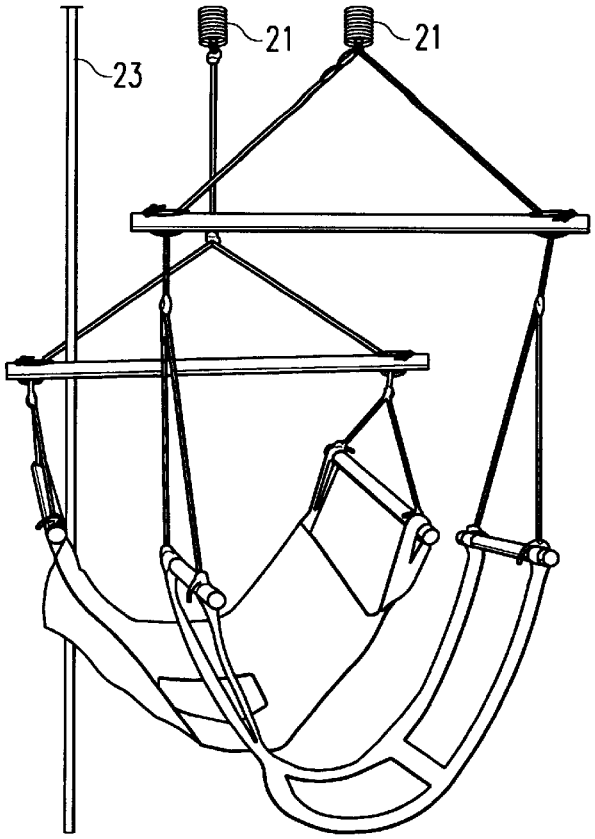
FIG. 10 is a perspective view of an assembly of the embodiments of FIGS. 1 and 3.
Figure 11:
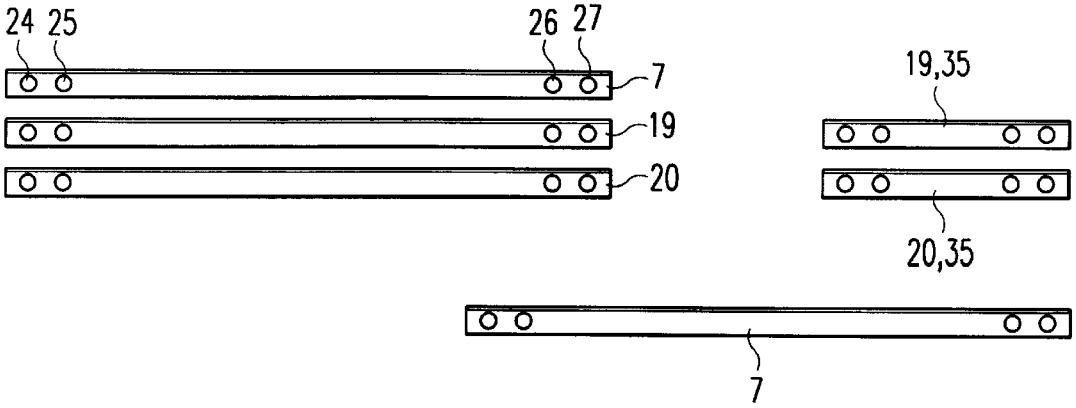
FIG. 11 is an illustration of various poles which are used in the frames of the preceding embodiments.

Both seats can be used singly and together! FIG. 10 There has not been gear like this erotic-seat which allows turning during love-making in the three million years before Christ and the 2000 years since! Until today there have not been any functionable devices available in the history of erotic, in movies, in erotic shops (like Beate Uhse, Orion, Dr. Müller, Anne Summers etc.)! There is no device that revolves smoothly without interruption and then reverses automatically.

This erotic-seat can be folded very small and rolled up (approximately 85 cm by 15 cm)!

The man or the woman turns the seat (FIG. 1) e.g. to the right by using their hands (counter clock-wise) because the rope is twisted like a corkscrew and automatically rewinds when released: fast and slow, left or right, without disturbing the feet and without electric power.

The unusual, excellent while also seemingly simple rope construction smoothly corrects irregularies in balance, which could be created through shifts in weight. The arrangement and mounting of the rope and the three poles is one of the most important prerequisite for the functioning of the device. The construction appears simple, but once has to have come up with the idea for it—which hasn't happened in the last 2000 years! The form of the chair with its four mounting loops also plays a decisive role! The seat is also adjustable and comfortable. The mounting loops and the upper pole (near the ceiling) spread the weight for the turning and make sure that even long-legged women will not be smothered by the chair due to body weight.

The name "Love-Spin/Love-Swing" was created by me, since such a device and such technology did not exist before! It was and is up until now in the described form and design unknown to the world! The principle of construction and the purpose-specific design are the deciding factors! The erotic seat allows many love positions to be used, which I have also created!

The arrangement of the ropes, the arrangement and type of knots used and the three poles are some of the most important prerequisites for the functioning of the device. These make the spinning, the balance, the retaining of balance, the ability to fold up and set up possible!

The knots and mounting loops are all directed internally, in order to provide greater stability. The screw holes, through which the ropes are run, result in two upper mounting loops (8,9) in the ceiling pole (7) which guarantees balance and suspension.

The seat (13) is adjustable and comfortable. The four mounting loops (15,16,17,18) spread the weight for the spinning further and make sure that even long-legged women will not be smothered by the chair due to body weight! The knees can, when necessary, be put through the space between the material and the poles (19,20) on both sides of the erotic seat!

The hole in the seat (14) has a size established through much experimentation and can be either square or round. It is double reinforced and specially sewn so that it can not fall apart. The fabric is also very strong. Netting or belts can also be substituted for the fabric! The belt variation is designed more for swinging, shaking, and bobbing, but can also turn. The variations work with the same principle and only look a little different due to the belts and size! These variations allow many different love positions to be used! If the Love-Spin and Love-Swing are used together, even more positions can be explored!

Figure 5:
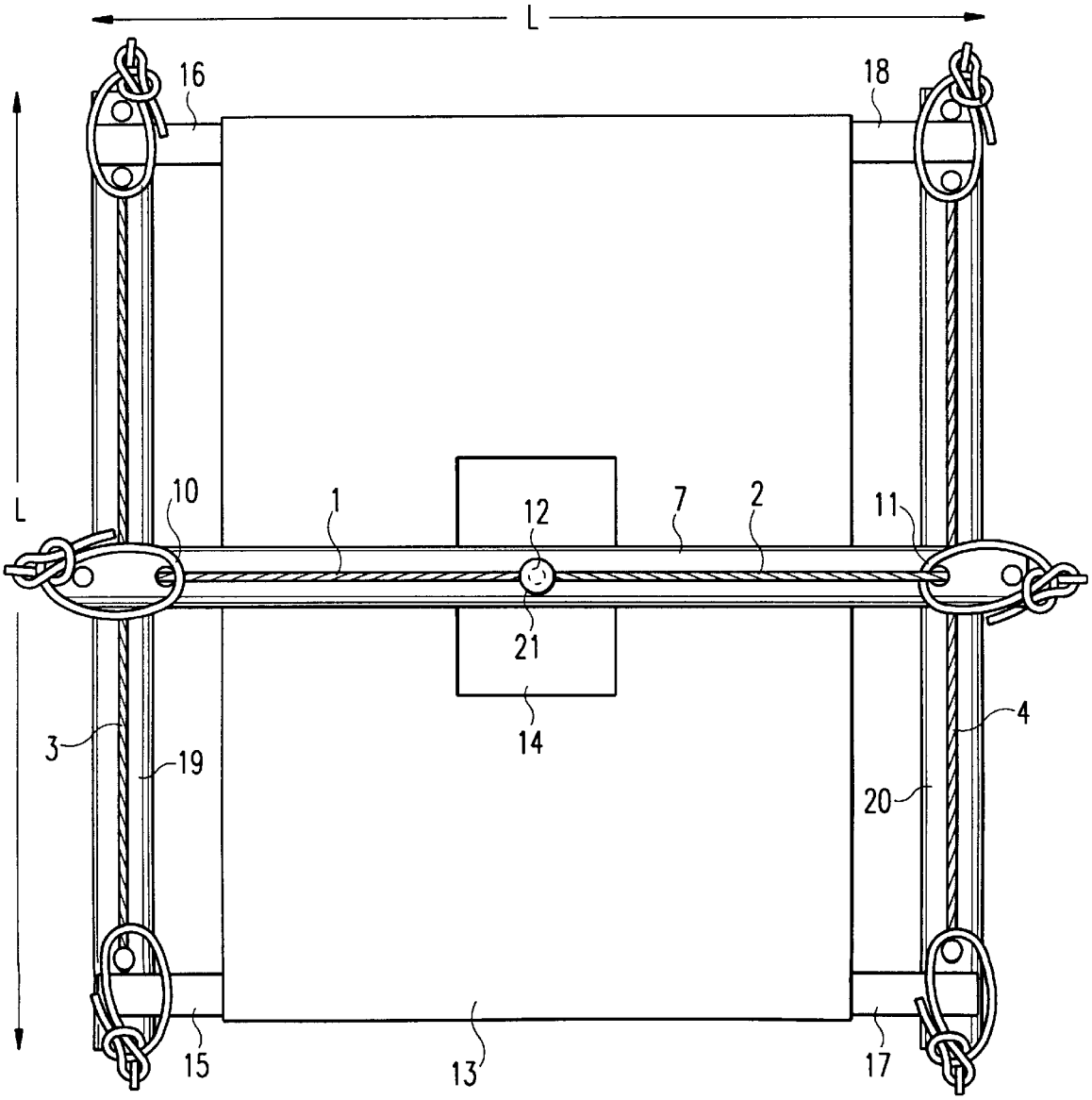
FIG. 5 is a plan view, taken from above, of the embodiment of FIG. 1.

FIG. 5 shows FIG. 1 schematically from above.

Figure 6:
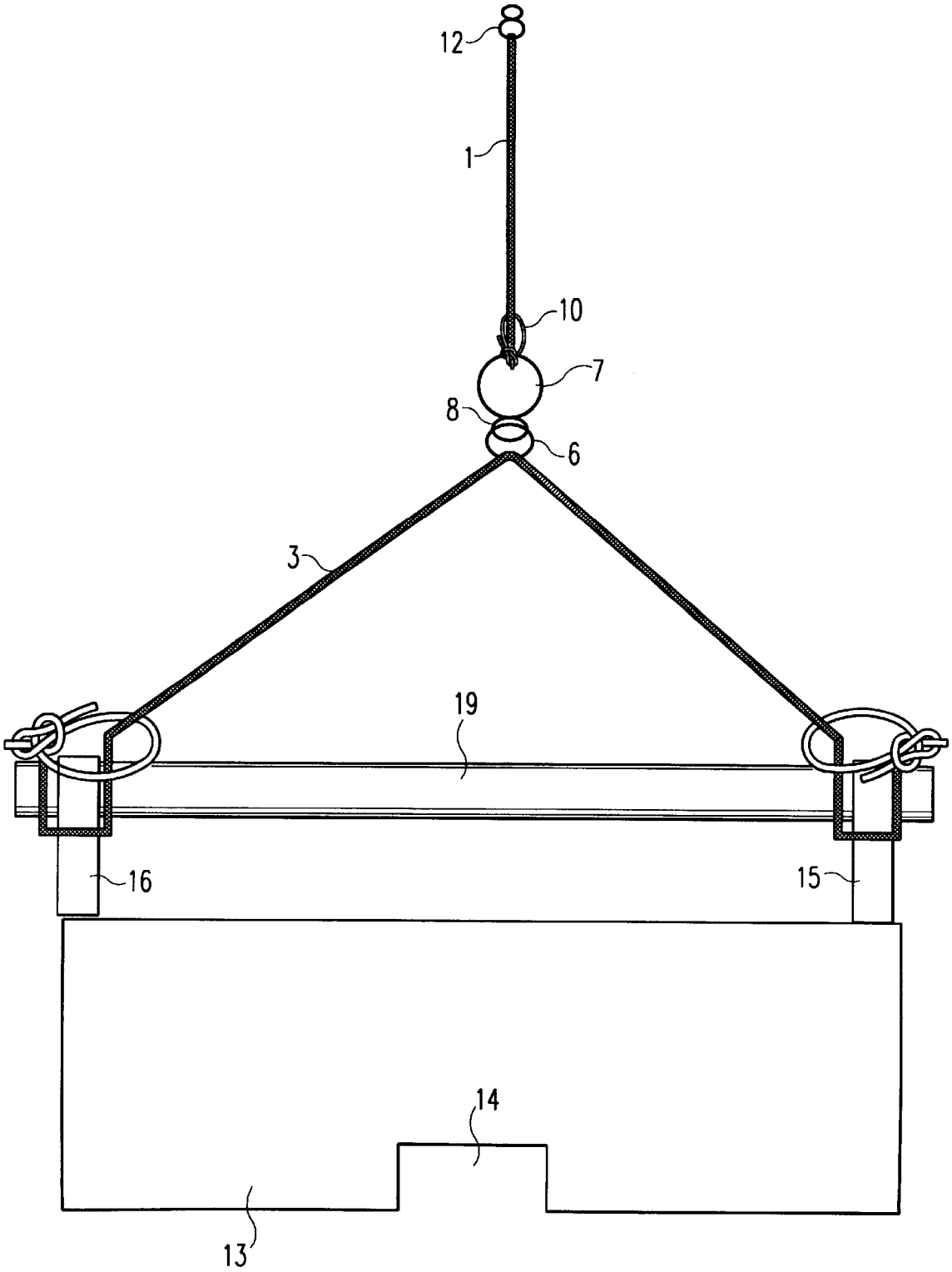
FIG. 6 is a side elevational view of the embodiment of FIG. 1.

FIG. 6 shows FIG. 1 schematically from the side.

Figure 7:
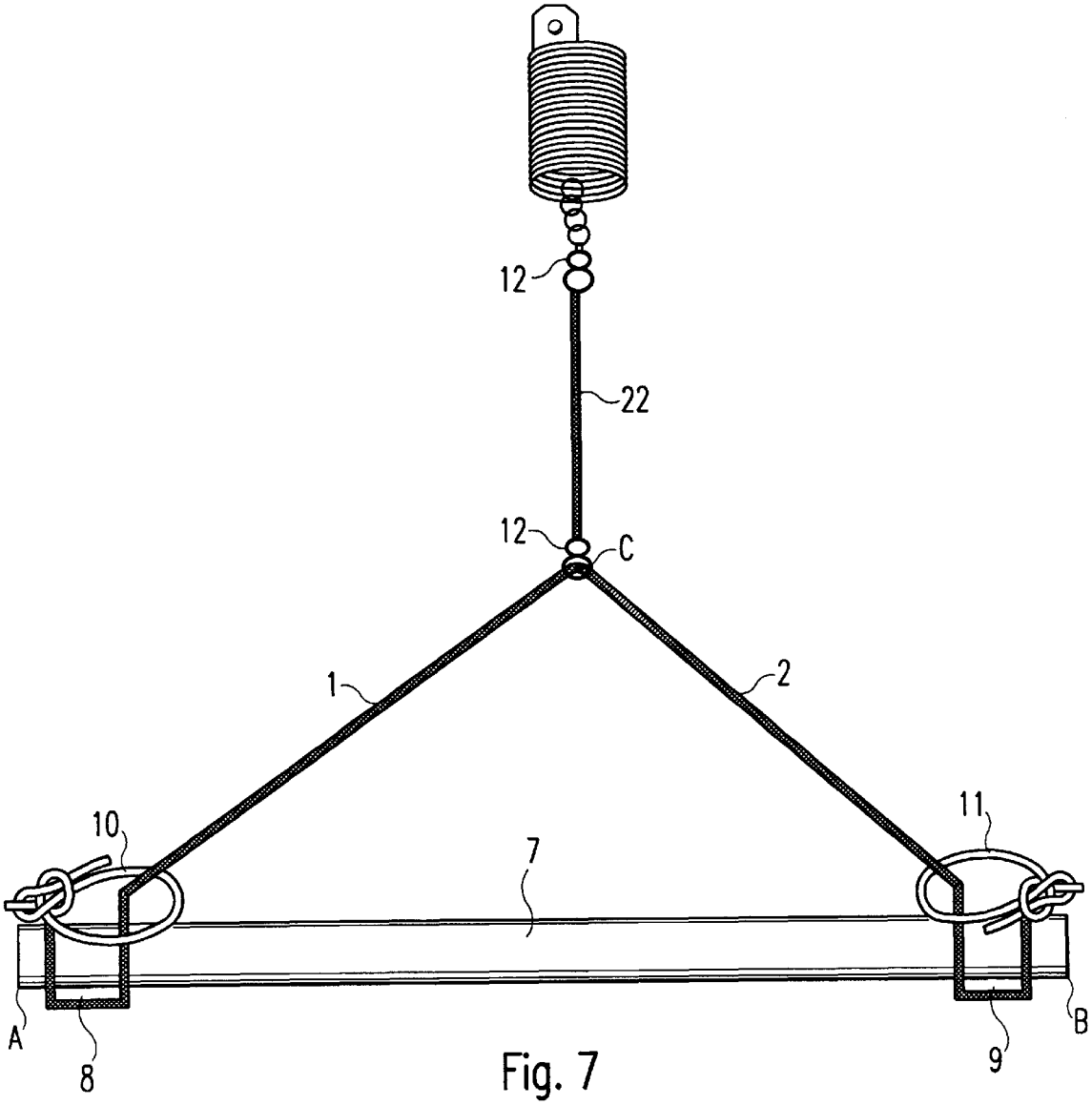
FIG. 7 is an enlarged view showing the mounting of an upper pole of the embodiment of FIG. 1.

FIG. 7 shows the installation of the upper ceiling pole.

Figure 8:
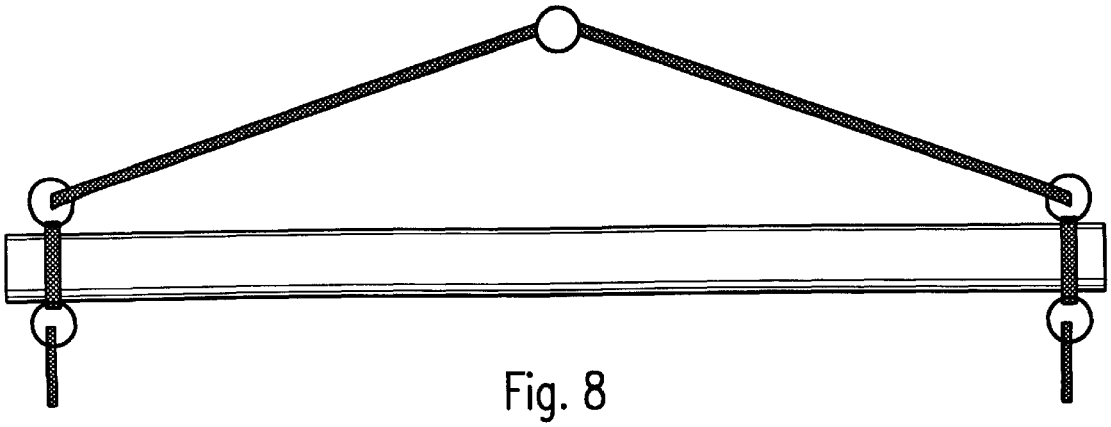
FIG. 8 is a view similar to FIG. 7 but showing an alternate upper pole mounting arrangement.

FIG. 8 shows that the poles are also connectable to the ropes with screws and eyes.

Figure 9:
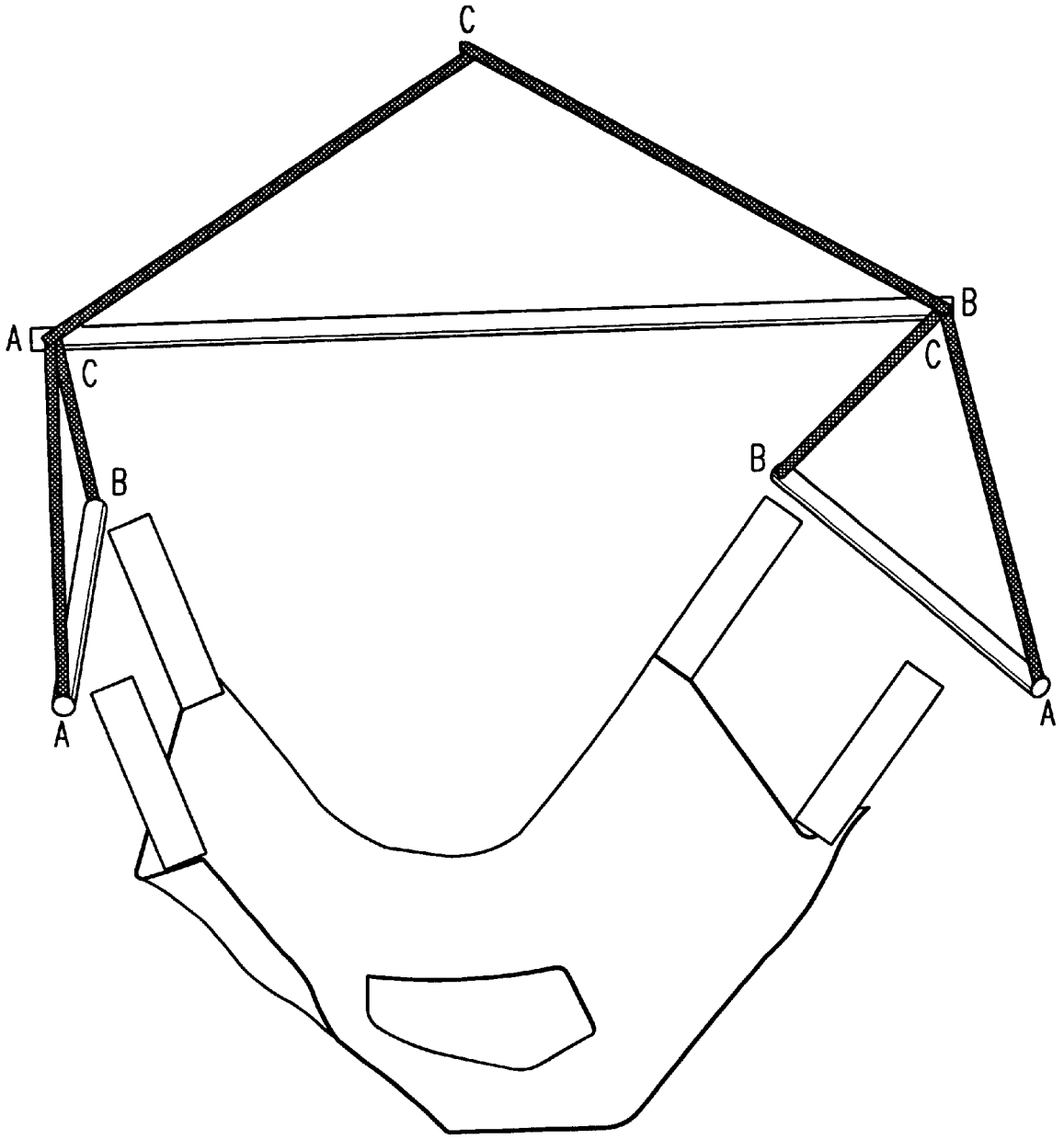
FIG. 9 is an exploded perspective view of the embodiment of FIG. 1.

FIG. 9 shows that the ropes could also be substituted by poles, so that the three components of the triangle (A B C) are connected.

Figure 4:
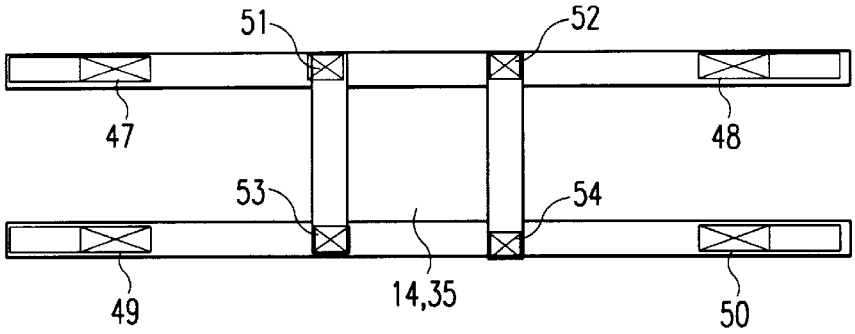
FIG. 4 is a plan view, of the seat construction of FIG. 3.

The following points are also important:

1. Mounting:

The square and symmetrical seat element (13, see FIG, 2) is made up of strong material or a similar flexible material, for instance netting or belts (FIG. 4). This material has a square or round central hole (14) in the middle. The chair element has four mounting loops (15,16,17,18), which function as the first mounting (from the bottom).

The frame is made up of three identical round poles (7, 19, 20). On each side are two screw holes placed exactly in the middle (four total): two which are distanced 2 centimeters from the ends of the pole and two which are distanced e.g. 8 cm. from the ends of the pole. The distance from one edge of the hole to the other is the same width as the belt, about 5 cm.

Each of the two mounting loops is layed over the two holes in the round pole on either side of the belt (FIG. 1). The mounting loops are found then between the two screw holes of the pole (15, 16, 17, 18).

2. Mounting

One end of a rope (3) with a loop (6) in the middle is put from above through the inner (8 cm.) hole in the pole underneath. Then the rope is pulled from underneath the pole back through, through the outer hole (2 cm.), and then a Bowline Knot (FIG. 1/*a*) is made around the inner rope. Then the other end of the rope (3) is pulled through the inner hole in the pole (8 cm.) from above, and then pulled from underneath back through the outer hole (2 cm.), and then a Bowline Knot (FIG. 1/*a*) is made around the inner rope.

The loop (6) from the rope (3) must now be exactly over the middle of the pole. The mounting loops (15, 16) are held by the rope exactly in between the two inner and outer holes of the pole.

The other side of the mounting of the seat element on the pole (20) is identical:

One end of a rope (4) with a loop (5) in the middle is put from above through the inner (8 cm.) hole in the pole (20) underneath. Then the rope is pulled from underneath the pole back through, through the outer hole (2 cm.), and then a Bowline Knot (FIG. 1/*a*) is made around the inner rope. Then the other end of the rope (4) is pulled through the inner hole in the pole (8 cm.) from above, and then pulled from underneath back through the outer hole (2 cm.), and then a Bowline Knot (FIG. 1/*a*) is made around the inner rope.

The loop (5) from the rope (4) must now be exactly over the middle of the pole. The mounting loops (17, 18) are held by the rope exactly in between the two inner and outer holes of the pole.

3. Mounting:

Mounting for the Seat-ceiling Part (FIG. 7)

A loop is made with a Bowline Knot (10) on the end of another rope (1) (FIG. 1/*a*). Then the long end of the rope is pulled from above through the third pole (7) (ceiling pole) through the outer hole, then at (8) through the rope loop (3) of the seat part, and then is pulled from underneath through the inner hole and then through the free bow-line-knot loop (10) (FIG. 1/*a*). The other side of the seat ceiling part mounting (FIG. 7) is the same:

A loop is made with a Bowline Knot (11) on the end of another rope (2) (FIG. 1/*a*). Then the long end of the rope is pulled from above through the third pole (7) (ceiling pole) through the outer hole, then at (9) through the rope loop of the seat part, and then is pulled from underneath through the inner hole and then through the free Bowline Knot loop (11) (FIG. 1/*a*). Both long ends run to the middle of the of the pole and are joined together with a Double Figure Eight Knot (12) (FIG. 1/*b*).

The pole (7) for the mounting of the seat- ceiling part stands at a 90-degree angle to the other two poles (19, 20). It spreads and keeps open the length of the seat element (13), while the other two poles (19, 20) keep the width of the seat element (13) open.

4. Mounting:

A steel spring (21) is hung between a second Double Figure Eight Knot (12) (FIG. 1/*b*) (FIGS. 1–12).

This seat is able to turn left or right, because the rope (22) is twisted around itself like a corkscrew between two Double Figure Eight Knots (12, 22) and automatically rewinds when released.

The suspension is a result of the steel spring (21) and is strengthened by the stand (23)! The swinging and shaking is automatically made possible by the mounting. The four mountings through the four ropes and the arrangement of the three poles are the most important features of the device.

All of the knots and holes can also be substituted by other mounting possibilities such as eyes and screws (FIG. 8).

Nr. 1000-06—Love-Spin

Love-Spin is a spinning, bobbing, swinging love-seat on the room ceiling! It will be installed with a plug or an accompanying stand.

Nr. 1000-07—Love-Swing

Love-Swing is a swinging, bobbing love-seat on the room ceiling! It will be installed with a plug or an accompanying stand.

The product Nr. 1000-06 and Nr. 1000-07 can be used singly and together!

Nr. 1000-06—Love-Spin (FIG. 1)

1. Love-Spin is made up of three identical, 3 cm in diameter and 85 cm of length, round poles (FIG. 11) out of pine or beech (7, 19, 20). On each side are two screw holes placed exactly in the middle (1.5 cm): two of which are distanced 2 centimeters from the ends of the pole (24) and

(27) (FIG. 11) and two of which are distanced 8 cm from the ends of the pole (25) and (26). The 12 screw holes total in the round poles (7, 19, 20) are made with an 8 mm drill (FIG. 11)!

2. The Love-Spin is also made out of: 2 Polyamid ropes (1, 2) that are 2.00 meters long and 6 mm in diameter (FIG. 1) and 2 Polyamid ropes (3,4) which are each 2.00 meters long for the seat part (FIG. 1).

Figure 2:
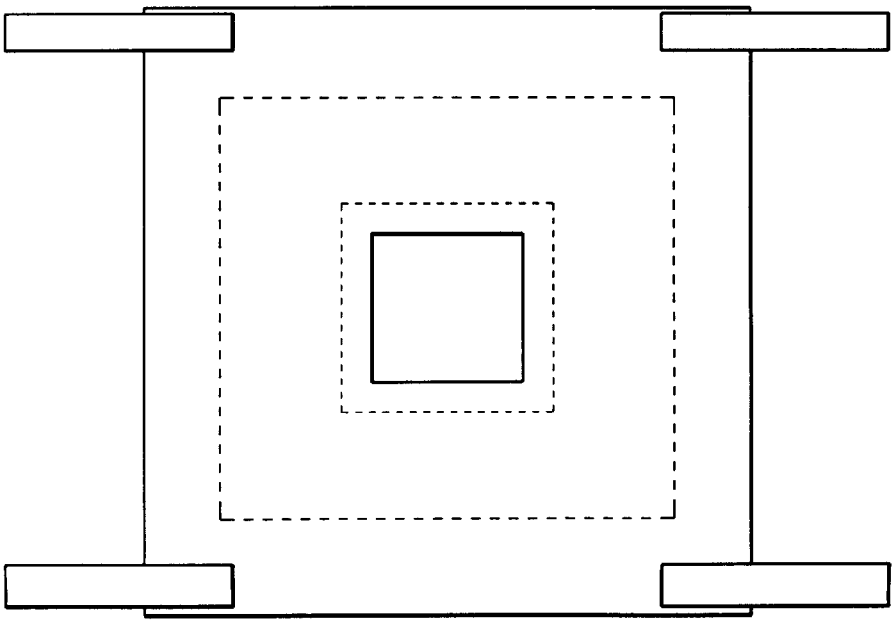
FIG. 2 is a plan view of the seat construction of the embodiment of FIG. 1.
Figure 12:
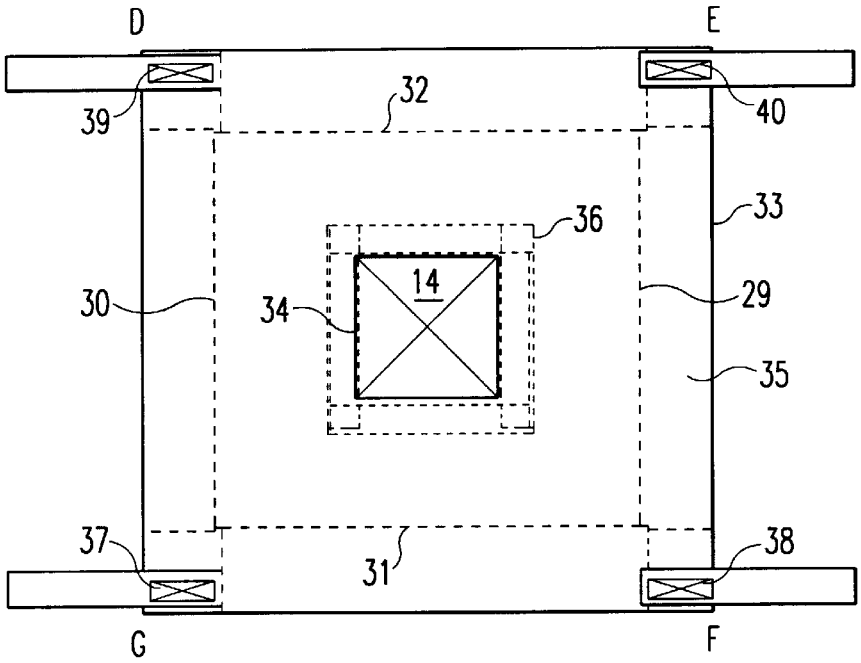
FIG. 12 is a view similar to FIG. 2 but showing an alternate construction.

3. The Love-Spin is also composed of a seat (13) of canvas nature 520 gram per square meter (FIGS. 1, 2, 12).

The necessary amounts of material are:

1. 1.00 meter by 1.00 meter for the seat.
2. 4 small pieces of fabric for the reinforcement of the corners and ends of the hole (28) (5 cm.×30 cm.) (FIG. 12).

The manufacturing process is:

a. The 100 cm. side of the material is folded 10 cm under (left) and sewed (29). The seam is about 9 cm from the outer edge of the material. It results in a long loop of about 9 cm in diameter!

b. The other 100 cm. side of the material is folded 10 cm under (left) and sewed (30). The seam is about 9 cm from the outer edge of the material. It results in a long loop of about 9 cm in diameter!

c. The third 100 cm. side of the material (80 cm after completion of the other seams) is folded 10 cm under (left) and sewed (31). The seam is about 9 cm from the outer edge of the material. It results in a long loop of about 9 cm in diameter!

d. The fourth 100 cm. side of the material (80 cm after completion of the other seams) is folded 10 cm under (left) and sewed (32). The seam is about 9 cm from the outer edge of the material. It results in a long loop of about 9 cm in diameter!

The resulting seat is 0.80 meters by 0.80 meters (FIGS. 2, 12). The corners are therefore four-times reinforced.

The thread is from Amann (1222), 30/3 polyester (Seralon) for industrial sewing machines.

e. Both opposite corners (D, F) (FIG. 12) are folded together along the diagonal, in order to find the middle point. The middle point is then marked by ironing, The same is done to the other comers (E,G); they are folded together along the diagonal and the middle is marked by the use of an iron.

f. Then 10 cm must be measured from the edge of each side. A square of dimensions 20 cm×20 cm must then be lightly drawn on to the left side of the fabric (34) with chalk (on the side parallel to the square side (33)).

Figure 13:
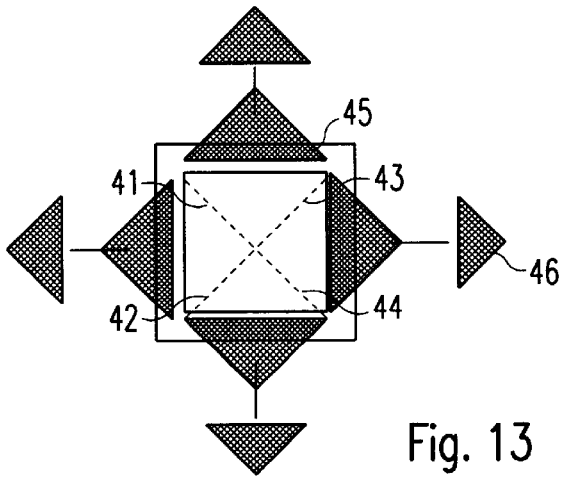
FIG. 13 is a fragmentary part of FIG. 12 showing, in exploded arrangement, further details of the alternate construction.
Figure 14:
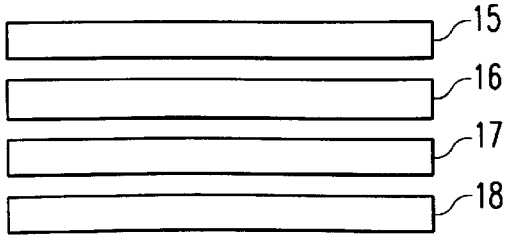
FIG. 14 is an illustration of strips which secure the seat to the frame of FIG. 1.

The four fabric pieces for the corner reinforcement (5 cm×30 cm) are now sewn exactly on the 20 cm×20 cm markings on the outside border (36) underneath (left) (34). Around the edge is now a border of about 4 cm wide (36), since the smaller fabric pieces must be hemmed approx. 0.5 cm. From the center working outwards, four cuts must be made along the ironed-in diagonal to near the fabric pieces on each corner of the 20 cm×20 cm square (FIG. 13) (41, 42, 43, 44).

g. The points of the resulting four triangles must then be cut off so that the edge (46) is about 4 cm long, and can be tucked underneath the fabric reinforcements. Now the square hole (20 cm×20 cm) must be sewn around the inside. A second seam must also be made 1 cm away from the hole. This results in a triple-reinforced edge underneath (material, triangular pieces, fabric reinforcers (45)) of about 4 cm, since the fabric reinforcements must be hemmed on each side about 0.5 cm. As a result, the seat has a triple-reinforced hole (14) of 20 cm×20 cm (FIG. 12) so that it will not come apart.

h. The seat of the Love-Spin is also made out of four 60 cm by 5 cm polyester belts (15, 16, 17, 18) (FIG. 14). The four belts must be folded in half (30 cm) and inserted into the loops (31, 32) (which have a 9 cm diameter) at a distance of 10 cm from the open side of the folded belting (FIG. 12) and sewn as close to the seat edges (37, 38, 39, 40) as possible. Twenty cm of the belting is outside of the loop.

The seams are sewn at right angles of about 4.5 cm×8 cm with a cross in the middle (37, 38, 39, 40)!The four 20 cm. long belts with the loops on the ends appear in the shape of an "H" and will herewith be called the "H-Cut."

4. The Assembly:

(Assembly of the seat)

a. Rope with a length of 2.00 meters must be folded in half and then a simple ½ knot must be made at 18 cm from the end so that a loop results (5).

The two loops on either side of the seat (I7, 18) with dimensions of 5 cm×20 cm must now be pulled over both of the wooden poles and placed between the two holes (2 cm and 8 cm from the edge)! Between (24) and (25) and on the opposite side between (26) and (27).

One end of a rope with a loop in the middle is pulled from above through the inner (8 cm.) (25) hole in the pole underneath. Then the rope is pulled from underneath the pole back through, through the outer hole (2 cm.) (24), and then a Bowline Knot is made around the inner rope.

Then the other end of the rope is pulled through the inner hole in the pole (8 cm.) (26) from above, and then pulled from underneath back through the outer hole (2 cm.)(27), and then a Bowline Knot must be made around the inner rope made 18 cm from the end of the rope.

The simple ½ knot (5) with the loop must now be positioned exactly over the middle of the pole—this is very easy to correct!

b. The other side of the seat:

Rope with a length of 2.00 meters must be folded in half and then a simple ½ knot must be made at 18 cm from the end so that a loop results (6). The two loops on either side of the seat (15, 16) with dimensions of 5 cm×20 cm must now be pulled over both of the wooden poles and placed between the two holes (2 cm and 8 cm from the edge)! Between (24) and (25) and on the opposite side between (26) and (27).

One end of a rope with a loop in the middle is pulled from above through the inner (8 cm.) hole (25) in the pole underneath. Then the rope is pulled from underneath the pole back through, through the outer hole (2 cm.) (24), and then a Bowline Knot is made around the inner rope.

Then the other end of the rope is pulled through the inner hole in the pole (8 cm.) (26) from above, and then pulled from underneath back through the outer hole (2 cm.)(27), and then a Bowline Knot must be made around the inner rope made 18 cm from the end of the rope. The simple ½ knot (6) with the loop must now be positioned exactly over the middle of the pole—this is very easy to correct!

5. The Assembly:

(Assembly for the seat ceiling part (FIG. 7))

2×200 cm Rope:

Measure 18 cm from the rope end and then make a 2 cm loop and a Bowline Knot.

Then the long end of the rope is pulled from above through the pole (85 cm long ceiling pole (7)) through the outer hole (24), and then through the rope loop (9) of the seat part, and then is pulled from underneath through the inner hole (FIG. 25) and then through the free Bowline Knot loop (11).

The Other Side of the Seat Ceiling Part Mounting:

Measure 18 cm from the rope end and then make a 2 cm loop and a Bowline Knot.

Then the long end of the rope is pulled from above through the pole (7) (ceiling pole) through the outer hole (27), then through the rope loop of the seat part (8), and then is pulled from underneath through the inner hole and then through the free Bowline Knot loop.

Both long ends run to the middle of the of the pole and are joined together with a Double Figure Eight Knot **(12*a*) (or a ½ knot)—easy to undo (12), Then at a distance of 20 cm–50 cm, a second Double Figure Eight Knot (12*b*) is made (22) turning part of the rope: between (12*a*) and (12*b*)**.

5. The Suspension Assembly (21):

One of the two long rope ends can now be pulled with the use of a positioning chain **(21*a*) (20 cm long), which can determine the fast and exact height position (and can also be left off (21*a*). Then a Double Figure Eight Knot (12*b*) (easier to undo for faster height adjustments) must be made. A steel spring (21) of about 5 cm in diameter and about 12 cm long and 6–7 mm strength is hung in the resulting loop (22). It produces the vertical swing. The spring is attached to a swinging hook on the ceiling or on a special stand (23)**.

The Spin-Stand/Sex-Swing-Stand consists of 65 cm (longest part) long aluminium parts which, when put together, stand at a height of 2.38 m (corresponding to the height of the ceiling). The width is 1.90 m and fits over any double-bed. When taken apart it takes up only half of a tennis bag and weighs only 25 kg. It can be put together anywhere in the world. The stand has the capacity to hold over 100 kg.

Nr. 1000-07—Love-Swing (FIG. 3)

Specification

1. The Love Swing is made up of a round pole out of beechwood or pine of about 3 cm in diameter and 85 cm long (7) and two round wooden poles of about 35 cm in length (19/35) and (20/35). Four holes (as described) are made in the middle (1.5 cm) on each side and on each pole. The manufacturing process is the same as that of the Love-Spin as described.

The assembly is also the same.

The only differences are detailed by the following points:

1. The 2 poles (19/35) and (20/35) are only 35 cm long instead of 85 cm.

2. The 2 Polyamid ropes for the seat are each only 1.95 m long instead of 2.00 m.

3. The seat is smaller and made only out of polyester belting:

Love-Swing (FIG. 4) is made out of polyester belting, like the 2 mm strength of an automobile safety belt.

1. 2×160 cm long×5 cm wide belts 2. 2×30 cm long×5 cm wide belts

The manufacturing process is:

a. Belts of dimension 160 cm×5 cm are laid in 20 cm strips on each of the 4 ends and 10 cm of the length of the belts must be sewn under to form a loop of about 10 cm in diameter (FIG. 4)! The seams are about 4.5 cm×10 cm with a cross in the middle (47, 48, 49, 50)!

The entire length of the seat is now 120 cm (FIG. 4)

b. At a distance of 45 cm from the end of the 1.20 m belt, the 30 cm long belt must be sewn at a right angle to the 1.20 m belt without overlapping (51). The same must be done on the other end (53).

c. The same must be done for the opposite side; At a distance of 45 cm from the end of the 1.20 m belt, the 30 cm long belt must be sewn at a right angle to the 1.20 m belt without overlapping (52). The same must be done on the other end (54).

The result is a hole in the seat (14/35) of dimension 20 cm×20 cm. The four belts make an "H" shape and will herewith called the "H-Cut," as it is called in the manufacturing of the Love-Spin (FIG. 4).

I claim:

1. A rotatable seat for erotic purposes comprising:

a frame constructed to be fixed to a singular point by means of a rope;

a substantially rectangular seat element suspended from said frame and made from a flexible material and provided with a symmetrically and centrally disposed square or round hole;

said frame comprising two spaced parallel poles from which said seat element is hung by means of mounting loops at its corners;

said frame further comprising a third pole extending perpendicular to, and in a plane parallel to a plane through said two parallel poles, and crossing said parallel poles in the middles thereof;

each of said parallel poles being hung from a respective end of said third pole; and rope means comprising two ropes, one end of each rope being secured to a respective end of said third pole and the other ends of said two ropes being connected together above the middle of said third pole to form a connection, which connection may be fixed to said fixed point.

2. A seat according to claim 1 wherein each of said two ropes is attached to the third pole at the respective ends thereof by means of a rope fastening means.

3. A seat according to claim 1 wherein the two parallel poles and the third pole are of substantially the same length.

4. A seat according to claim 1 further including a spiral spring element extending from said connection and arranged to be connected to said fixed point.

5. A seat according to claim 1 wherein the fixed point is provided in a and disassemblable framework.

6. A seat according to claim 1 wherein the fixed point is provided in a form of a hook plugged into a ceiling of a room.

7. A seat according to claim 1 wherein the edge of the hole and the edges of the seat element corresponding to the two parallel poles comprise a soft and flexible sewn hem.

8. A seat according to claim 1 wherein the seat element comprises textile belts which are sewn together, at least two of said belts extending parallel to each other and at least two other belts extending perpendicular to the first belts, thereby forming the hole, and wherein the mounting loops are provided by lengths of said at least two of said belts at opposite ends of the lengths thereof.

9. A seat according to claim 1 or claim 8 wherein the lengths of said mounting loops are dimensioned such that at least one human knee can fit comfortably between the respective pole and a corresponding peripheral edge of the seat element.

* * * * *